US005209193A

United States Patent [19]

Uchida et al.

[11] Patent Number: 5,209,193

[45] Date of Patent: May 11, 1993

[54] INTAKE- AND/OR EXHAUST-VALVE TIMING CONTROL SYSTEM FOR INTERNAL COMBUSTION ENGINES

[75] Inventors: Katsuhiko Uchida; Seiji Suga, both of Kanagawa, Japan

[73] Assignee: Atsugi Unisia Corp., Atsugi, Japan

[21] Appl. No.: 796,478

[22] Filed: Nov. 22, 1991

[30] Foreign Application Priority Data

Nov. 26, 1990 [JP] Japan ..... 2-322178

[51] Int. Cl.[5] ..... F01L 1/34; F01M 1/06

[52] U.S. Cl. ..... 123/90.17; 123/90.34; 123/90.31

[58] Field of Search ..... 123/90.15, 90.17, 90.31, 123/90.33, 90.34; 464/2

[56] References Cited

U.S. PATENT DOCUMENTS 4,231,330 11/1980 Garcea ..... 123/90.15
4,811,698 3/1989 Akasaka et al. ..... 123/90.17
5,058,539 10/1991 Saito et al. ..... 123/90.17
5,144,921 9/1992 Clos et al. ..... 123/90.34

FOREIGN PATENT DOCUMENTS 0245791 11/1987 European Pat. Off. .
0340821 11/1989 European Pat. Off. .
0356162 2/1990 European Pat. Off. .
4024056 9/1991 Fed. Rep. of Germany .

*Primary Examiner*—E. Rollins Cross
*Assistant Examiner*—Weilun Lo
*Attorney, Agent, or Firm*—Bachman & LaPointe

[57] ABSTRACT

An intake- and/or exhaust-valve timing control system for an internal combustion engine comprises a timing belt pulley having a driven connection with an engine crankshaft, a camshaft journaled by a bearing member mounted on a cylinder head and receiving torque transmitted from the timing belt pulley, a ring gear mechanism for adjusting a relative phase angle between the timing belt pulley and the camshaft. The valve timing control system includes a first hydraulic circuit provided for drivingly controlling the ring gear mechanism via fluid pressure depending upon the operating state of the engine and a second hydraulic circuit provided for lubricating frictional surfaces between the bearing member and the camshaft. The first and second hydraulic circuits are separated from each other. The valve timing control system includes a directional control valve connected to the first hydraulic circuit for switching the direction of working fluid flowing through the first hydraulic circuit.

6 Claims, 1 Drawing Sheet

INTAKE- AND/OR EXHAUST-VALVE TIMING CONTROL SYSTEM FOR INTERNAL COMBUSTION ENGINES

BACKGROUND OF THE INVENTION

1. Field of the Invention

The present invention relates to an intake- and/or exhaust-valve timing control system for internal combustion engines which is variably capable of controlling the intake- and/or exhaust-valve timing depending upon the operating state of the engine, for example the magnitude of engine load and/or engine speed.

2. Description of the Prior Disclosure

Recently, there have been proposed and developed various intake- and/or exhaust-valve timing control systems for internal combustion engines for generating optimal engine performance according to the operating state of the engine.

As is generally known, the valve timing is determined such that optimal engine performance is obtained, however the predetermined valve timing is not suitable under all operating conditions. For example, when the engine is operating within a range of low revolutions, higher torque will be obtained with an intake-valve timing earlier than the predetermined valve timing.

Such a conventional intake- and/or exhaust-valve timing control system for internal combustion engines has been disclosed in U.S. Pat. Nos. 4,231,330 and 4,535,731. In these conventional valve timing control systems, a cam sprocket is rotatably supported through a ring gear mechanism by the front end of a camshaft. The ring gear mechanism includes a ring gear having an inner toothed portion engaging another toothed portion formed on the front end of the camshaft and an outer toothed portion engaging an inner toothed portion formed on the inner peripheral wall of the cam sprocket. In this manner, the ring gear rotatably engages between the cam sprocket and the camshaft. The ring gear is normally biased in the axial direction of the camshaft by means of a return spring, such as a coil spring. At least one of the two meshing pairs of gears is helical. The result is that axial sliding movement of the ring gear relative to the camshaft causes the camshaft to rotate about the cam sprocket and therefore the phase angle between the camshaft and the cam sprocket (and consequently, the phase angle between the camshaft and the engine crankshaft) is relatively varied. The ring gear moves as soon as one of the two opposing forces acting on it, namely the preloading pressure of the above spring means or the oil pressure applied from the oil pump to the ring gear, exceeds the other. However, in this conventional valve timing control systems, a hydraulic circuit serving as a ring gear driving hydraulic circuit functions to feed a controllable oil pressure to a pressure chamber defined at the one end of the ring gear and in addition to feed an engine lubricating oil for lubricating rotational frictional surfaces between a cylinder head, a bearing member, and a camshaft journaled by the cylinder head and the bearing member. That is, a single hydraulic circuit is commonly utilized to provide the axial sliding movement of the ring gear and to lubricate the frictional surfaces between the camshaft, the cylinder head and the bearing member.

For example, even when an oil supply to the pressure chamber is blocked during a low engine load, a small magnitude of working fluid pressure is still maintained for continuously supplying lubricating oil to the rotational friction surfaces between the camshaft and the bearing member. In the previously noted construction of the conventional valve timing control system, the slight magnitude of fluid pressure is continuously retained in the hydraulic circuit, with the result that working fluid in the pressure chamber is not exhausted smoothly and quickly and therefore quick, axial sliding movement of the ring gear is prevented when an oil supply to the pressure chamber is stopped. Consequently, the prior art valve timing control system exhibits a low step-response characteristic with regard to an intake- and/or exhaust-valve timing control executed by a variable valve timing control system.

SUMMARY OF THE INVENTION

It is, therefore in view of the above disadvantages, an object of the present invention to provide a variable intake- and/or exhaust-valve timing control system for internal combustion engines, which can provide a high step-response of an intake- and/or exhaust-valve timing control.

It is another object of the invention to provide a variable intake- and/or exhaust-valve timing control system for internal combustion engines, which can provide a high step-response of an intake- and/or exhaust-valve timing control when the operating state of the engine is varied from a high engine load to a low engine load.

In order to accomplish the aforementioned and other objects, an intake- and/or exhaust-valve timing control system for an internal combustion engine comprises a rotating member having a driven connection with a crankshaft of the engine, a camshaft journaled by a bearing member mounted on a cylinder head and receiving torque transmitted from the rotating member, a phase-angle adjusting mechanism for adjusting a relative phase angle between the rotating member and the camshaft, a first hydraulic circuit provided for drivingly controlling the phase-angle adjusting mechanism via fluid pressure depending upon the operating state of the engine, a second hydraulic circuit provided for lubricating frictional surfaces between the bearing member and the camshaft, the first and second hydraulic circuits being separated from each other, a directional control valve connected to the first hydraulic circuit for switching the direction of working fluid flowing through the first hydraulic circuit. The first hydraulic circuit includes a supply and drain fluid passage serving as both oil supply passage and oil drain passage. The supply and drain fluid passage is disposed in the cylinder head. The directional control valve communicates upstream thereof with the supply and drain fluid passage and communicates downstream thereof with a working fluid pressure source. The directional control valve may be preferably comprised of three ports two position directional control valve employing a first port connected to the supply and drain fluid passage, a second port connected to the fluid pressure source, and a third port connected to an oil drain passage communicated an engine oil pan. The supply and drain fluid passage included in the first hydraulic circuit and a lubricating oil passage included in the second hydraulic circuit are juxtaposed to each other in the cylinder head. The directional control valve is arranged in such a manner as to traverse only the supply and drain fluid passage.

The phase-angle adjusting mechanism may comprise a ring gear disposed between the rotating member and the camshaft. The ring gear includes inner and outer toothed portions at the inner and outer peripheral surfaces thereof. The inner and outer toothed portions are respectively meshed with an outer toothed portion formed in the outer peripheral surface of the camshaft and an inner toothed portion formed in the inner peripheral surface of the rotating member. At least one of the two meshing pairs of toothed portions is helical to provide sliding movement of the ring gear in the axial direction of the camshaft, for varying a relative phase angle between the rotating member and the camshaft in such a manner as to control intake- and/or exhaust-valve timing of the engine.

DESCRIPTION OF THE PREFERRED EMBODIMENT

Figure 1:
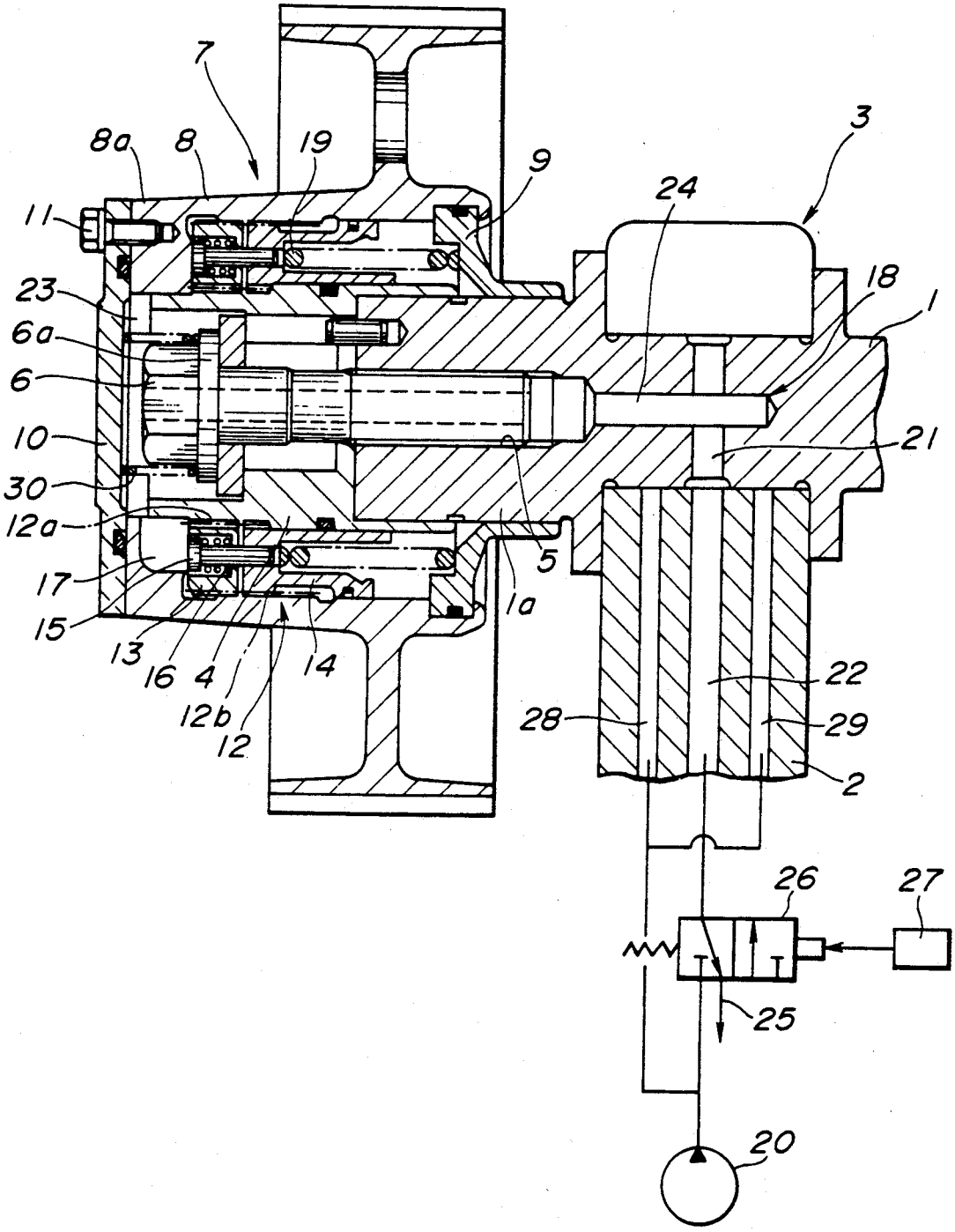
FIG. 1 is a longitudinal cross-sectional view illustrating a preferred embodiment of an intake- and/or exhaust-valve timing control system for internal combustion engines according to the invention.

The principles of the present invention applied to intake- and/or exhaust-valve timing control systems for internal combustion engines are illustrated in FIG. 1.

FIG. 1 shows the front section of a camshaft 1 provided for opening and closing an intake- and/or exhaust-valve (not shown). As clearly shown in FIG. 1, the camshaft is journaled by a cylinder head 2 and a bearing member 3. Reference numeral 7 denotes a substantially cylindrical timing belt pulley including a timing belt pulley driven by a timing belt for transmitting torque from an engine crankshaft (not shown). The timing belt pulley 7 and the camshaft 1 are coaxially arranged with respect to each other. The timing belt pulley 7 includes an essentially cylindrical section 8 in addition to the timing belt pulley. The cylindrical section 8 employs a relatively long inner toothed portion at the inner peripheral surface thereof. The timing belt pulley 7 is hermetically closed by a front lid 10 attached to the front end 8*a* of the substantially annular hub thereof in a water-tight fashion by means of bolts 11. A sleeve 4 having an outer toothed portion is firmly connected to the outer peripheral surface of a front end 1*a* of the camshaft 1 by means of a bolt 6 screwed into a threaded portion 5. A ring gear mechanism 12 is provided between the timing belt pulley 7 and the sleeve 4. The ring gear mechanism 12 includes a ring gear member being comprised of first and second ring gear elements 13 and 14, a plurality of connecting pins 15, and an annular rubber bushing or a plurality of coil springs 16. The first and second ring gear elements 13 and 14 are formed in such a manner as to divide a relatively long ring gear, including inner and outer toothed portions 12*a* and 12*b* into two ring gear elements. The inner and outer toothed portions 12*a* and 12*b* are respectively meshed with the outer toothed portion of the sleeve 4 and the inner toothed portion of the timing belt pulley 7. At least one of two meshing pairs of teeth is helical to provide axial sliding movement of the ring gear relative to the camshaft 1. The axially forward movement (viewing FIG. 1) of the ring gear 12 is restricted by an inner shoulder of the inner periphery of the pulley 7 in such a manner that the front end of the first ring gear element 13 abuts the inner shoulder of the pulley 7. On the other hand, the axially backward movement of the ring gear 12 is restricted by the front end of a substantially annular retainer 9 which is fixed on the rear end of the hub of the pulley 7 by caulking. An annular pressure chamber 17 is defined by the inner peripheral surface of the pulley 7, the outer peripheral surface of the sleeve 4, and the front end surface of the first ring gear element 13 for introducing working fluid fed from an oil pan (not shown) via an engine oil pump 20.

A drive mechanism for the previously described ring gear member 12 comprises a hydraulic circuit 18 for supplying and draining the working fluid from the oil pan to the pressure chamber 17, a compression spring 19 disposed between the second ring gear element 14 and the retainer 9 for normally biasing the ring gear member 12 in an axially forward direction (viewing FIG. 1), and a directional control valve 26 hereinafter described in detail.

The hydraulic circuit 18 includes a radially extending fluid passage 21 bored in the front journaled section of the camshaft 1, a fluid passage 22 penetrating in the cylinder head and exposing to the radial fluid passage 21, a fluid chamber 23 defined between the front end of the sleeve 4 and the inner wall of the front lid 10, and an axially extending fluid passage 24 communicated through the fluid chamber 23 with the pressure chamber 17. The axial fluid passage 24 is also connected through an axially extending center bore of the bolt 6 to the radial fluid passage 21.

A three-way electromagnetic valve 26 is provided in the fluid passage 22 for selectively switching either communication between the fluid passage 22 and the outlet of the oil pump 20 serving as a working fluid pressure source or communication between the fluid passage 22 and an oil drain passage 25. The radial fluid passage 21 communicates upstream thereof through an annular oil passage defined between the outer peripheral surface of the front journaled section of the camshaft 1 and the semi-circular curved surfaces of the cylinder head 2 and the bearing member 3, via the electromagnetic valve 26 and a main oil gallery, with the oil pump 20. The electromagnetic valve 26 is controlled by a controller 27 which determines the operating state of the engine on the basis of signals output from various sensors, such as a crank angle sensor for monitoring the crank angle of the engine crankshaft, and an air flow meter for monitoring the amount of intake air introducing through the air cleaner. In the preferred embodiment, three-ports two-position directional control valve is utilized as a three-way electromagnetic valve 26, as seen in FIG. 1.

In the valve timing control system according to the invention, a pair of hydraulic circuits 28 and 29 are defined in the cylinder head 2 in such a manner as to sandwich the fluid passage 22 substantially in parallel with the fluid passage 22, so as to lubricate frictional surfaces between the camshaft 1, the cylinder head 2, and the bearing member 3. Note that the hydraulic circuits 28 and 29 included in the engine oil lubricating system are provided independently of the hydraulic circuit 18 included in the valve timing control system. Both hydraulic circuits 28 and 29 communicate upstream thereof through the main oil gallery with the oil pump 20 and expose downstream thereof directly to a slight aperture defined between the outer peripheral surface of the camshaft 1 and the semi-circular curved, inner peripheral surfaces of the cylinder head 2 and the bearing member 3, not via the electromagnetic valve 26.

A coil spring 30 is operably provided between the inner wall of the front lid 10 and a washer 6a of the bolt 6 so as to normally bias the timing belt pulley 7 leftwards (viewing FIG. 1) with the result that the retainer 9 and the right end of the sleeve 4 are abutted to each other. As a result, a suitable frictional resistance is created between the retainer 9 and the sleeve 4. As is well known, the camshaft 1 does not always rotate smoothly according to rotation of the timing belt pulley 7 but tends to rapidly rotate in either a normal or reverse rotational direction against rotation of the timing belt pulley 7 with a relatively large acceleration or fluctuations in rotational speed, due to fluctuations in engine torque transmitted through the engine crankshaft and reaction forces created by valve springs (not shown). As previously described, such torque fluctuations in the camshaft causes noise due to backlashes between the two meshing pairs of teeth formed on the inner and outer peripheries of the ring gear 12 and the inner periphery of the timing belt pulley 7 and the outer periphery of the sleeve 4. The previously noted frictional resistance reduces such noise, since such a rapid torque fluctuation in a camshaft relative to the timing belt pulley is suppressed by the friction resistance.

The intake- and/or exhaust-valve timing control system for internal combustion engines according to the invention, operates as follows.

When the engine is operating under high load, the control signal generated from the previously noted controller 27 is output to an exciting coil of the electromagnetic valve 26, with the result that the solenoid valve 26 is activated by the controller. Therefor, the valve 26 blocks the communication between the fluid passage 22 and the fluid drain passage 25 and establishes the communication between the fluid passage 22 and the main oil gallery. As a result, the pressurized working fluid from the oil pump 20 is fed through the main oil gallery, the electromagnetic valve 26, the fluid passage 22, the radial fluid passage 21, the axial fluid passage 24, and the fluid chamber 23 to the pressure chamber 17, in that order. Therefore, since the fluid pressure within the pressure chamber 17 becomes increased, the ring gear 12 is moved in the right direction (viewing FIG. 1) against the spring force created by the spring 19, with the result that the phase angle between the timing belt pulley 7 and the camshaft 1 is relatively changed to a predetermined phase angle which corresponds to an optimal phase angle during high engine load condition. Under this condition, the timings of intake-valve opening and closing are advanced in relation to the piston position in the cylinder, thereby resulting in a high combustion efficiency.

On the other hand, when the operating state of the engine is changed from a high load to a low load, the electromagnetic valve is deactivated in the absence of the control signal from the controller 27. FIG. 1 shows an OFF state of the electromagnetic valve 27. The valve 26 serving as three-ports two-position directional control valve blocks the communication between the fluid passage 22 and the main oil gallery and establishes the communication between the fluid passage 22 and the fluid drain passage 25. As a result, the working fluid in the pressure chamber 17 is drained through the fluid chamber 23, the axial fluid passage 24, the radial fluid passage 21, the fluid passage 22, and the fluid drain passage 25 to the oil pan, in that order. For this reason, since the fluid pressure in the pressure chamber 17 becomes quickly decreased and as a result the ring gear 12 is returned in the left direction by means of the spring 19 and is positioned in the leftmost position. Thus, the relative phase angle between the timing belt pulley 7 and the camshaft 1 is set to a predetermined phase angle in which intake- and/or exhaust-valve timing relative to the crank angle is initialized. Under this condition, the timings of intake-valve opening and closing are in general delayed in relation to the piston position, thereby resulting in a high charging efficiency of air-fuel mixture introduced through the intake-valve to the combustion chamber of the engine, due to the inertia of fluid mass of the introduced mixture. In this manner, the intake- and/or exhaust-valve timing is variably controlling depending upon the operating state of the engine. During transition from a high engine load to a low engine load, since the working fluid in the pressure chamber 17 is rapidly and smoothly exhausted through the previously noted predetermined fluid drain path, the valve timing control can be executed with a high step-response.

In addition, lubricating oil is continuously supplied from the oil pump 20 through the hydraulic circuits 28 and 29 both separated from the hydraulic circuit 18 to the slight aperture defined between the outer peripheral surface of the camshaft 1, and the semi-circular inner peripheral surfaces of the cylinder head 2 and the bearing member 3. This results in a continuously sufficient lubricating action and reliably prevents burning of the journaled section of the camshaft 1.

Furthermore, the working fluid in the pressure chamber 17 is directly returned through the previously mentioned fluid drain path into the oil pan, thereby preventing the working fluid from mixing with the blow-by gas contained in the cylinder head 2. As a result, high emission control performance may be maintained.

While the foregoing is a description of the preferred embodiment for carrying out the invention, it will be understood that the invention is not limited to the particular embodiments shown and described herein, but that various changes and modifications may be made without departing from the scope or spirit of the invention as defined by the following claims.

What is claimed is:

1. An intake- and/or exhaust-valve timing control system for an internal combustion engine comprising:

a rotating member having a driven connection with a crankshaft of said engine;

a camshaft journaled by a bearing member mounted on a cylinder head and receiving torque transmitted from said rotating member;

a phase-angle adjusting mechanism for adjusting a relative phase angle between said rotating member and said camshaft;

a first hydraulic circuit provided for drivingly controlling said phase-angle adjusting mechanism via fluid pressure depending upon the operating state of said engine;

a second hydraulic circuit provided for lubricating frictional surfaces between said bearing member and said camshaft, said first and second hydraulic circuits being separated from each other;

a directional control valve connected to said first hydraulic circuit for switching the direction of working fluid flowing through said first hydraulic circuit;

said first hydraulic circuit including a supply and drain fluid passage serving as both oil supply passage and oil drain passage, said second hydraulic circuit including a lubricating oil passage, said supply and drain fluid passage and said lubricating oil passage both being disposed in said cylinder head; and said lubricating oil passage including at least two oil ducts, respectively arranged at both sides of said supply and drain fluid passage in an axial direction of said camshaft, in order to enhance a lubricating efficiency.

2. The intake- and/or exhaust-valve timing control system as set forth in claim 1, wherein said directional control valve communicates upstream thereof with said supply and drain fluid passage and communicates downstream thereof with a working fluid pressure source.

3. The intake- and/or exhaust-valve timing control system as set forth in claim 2, wherein said directional control valve is comprised of three ports two position directional control valve employing a first port connected to said supply and drain fluid passage, a second port connected to said fluid pressure source, and a third port connected to an oil drain passage communicated with an engine oil pan.

4. The intake- and/or exhaust-valve timing control system as set forth in claim 1, wherein said supply and drain fluid passage included in said first hydraulic circuit and said lubricating oil passage included in said second hydraulic circuit are juxtaposed to each other in said cylinder head and said directional control valve is arranged in such a manner as to traverse only said supply and drain fluid passage.

5. The intake- and/or exhaust-valve timing control system as set forth in claim 1, wherein said phase-angle adjusting mechanism comprises a ring gear disposed between said rotating member and said camshaft.

6. The intake- and/or exhaust-valve timing control system as set forth in claim 5, wherein said ring gear includes inner and outer toothed portions at the inner and outer peripheral surfaces thereof, the inner and outer toothed portions being respectively meshed with an outer toothed portion formed in the outer peripheral surface of said camshaft and an inner toothed portion formed in the inner peripheral surface of said rotating member, at least one of the two meshing pairs of toothed portions being helical to provide sliding movement of said ring gear in the axial direction of said camshaft, for varying a relative phase angle between said rotating member and said camshaft in such a manner as to control intake- and/or exhaust-valve timing of said engine.

* * * * *